US006009286A

United States Patent [19]

Watanabe et al.

[11] Patent Number: 6,009,286

[45] Date of Patent: Dec. 28, 1999

[54] IMAGE FORMING APPARATUS WITH DISTURBANCE ELIMINATION

[75] Inventors: Takeshi Watanabe, Chiba-ken; Takao Izumi, Kanagawa-ken, both of Japan

[73] Assignee: Kabushiki Kaisha Toshiba, Kawasaki, Japan

[21] Appl. No.: 09/151,399

[22] Filed: Sep. 11, 1998

[30] Foreign Application Priority Data

Sep. 12, 1997 [JP] Japan ..... 9-248290

[51] Int. Cl.[6] ..... G03G 15/00

[52] U.S. Cl. ..... 399/44; 399/45; 399/66; 399/128; 399/296; 399/314

[58] Field of Search ..... 399/44, 45, 66, 399/128, 296, 313, 314

[56] References Cited

U.S. PATENT DOCUMENTS

| | | | |
|---|---|---|---|
| 4,593,989 | 6/1986 | Fujiwara et al. | 399/190 |
| 5,166,734 | 11/1992 | Pinhas et al. | 399/390 |
| 5,541,718 | 7/1996 | Oono | 399/297 |
| 5,598,256 | 1/1997 | Kimura et al. | 399/66 |
| 5,761,568 | 6/1998 | Haragakiuchi et al. | 399/66 |
| 5,794,110 | 8/1998 | Kasai et al. | 399/313 |

*Primary Examiner*—Arthur T. Grimley
*Assistant Examiner*—William A. Noē
*Attorney, Agent, or Firm*—Foley & Lardner

[57] ABSTRACT

An image forming apparatus of the present invention includes an image forming unit to form a developer image on an image carrier, a transfer unit to transfer a developer image on an image receiving medium, a conveyor belt provided in contact with the transfer unit to carry and convey the image receiving medium with a developer image transferred by the transfer unit and a voltage applying portion to apply voltage to the transfer unit. This image forming apparatus further includes a controller to control voltage to be applied by the voltage applying portion to at least either one of the leading edge portion and the trailing edge portion of the image receiving medium in the direction conveyed by the conveyor belt so that it becomes higher than voltage to be applied to the middle portion in the conveying direction of the image receiving medium.

10 Claims, 6 Drawing Sheets

IMAGE FORMING APPARATUS WITH DISTURBANCE ELIMINATION

BACKGROUND OF THE INVENTION

1. Field of the Invention

The present invention relates to an image forming apparatus that is used as, for instance, a copying machine.

2. Description of the Related Art

In recent years, in digital copying machines having a high processing speed, the photo-conductive drum having a large diameter is used. So, it is difficult to separate a paper from the photo-conductive drum by the paper's stickiness after the transferring of the developed image onto the paper from the photo-conductive drum surface.

For instance, U.S. Pat. No. 5,585,906 (Dec. 17, 1996; Takahashi et al.) shows a method to electrostatically adsorb a paper to a transfer belt by using it as a transfer member.

In case of a belt transfer system, as a paper is conveyed as being adsorbed on a transfer belt, a paper must be separated from the transfer belt at the most downstream side of the transfer belt after conveyed. Normally, a transfer belt is supported by rollers in diameter 12–40 mm and paper can be separated by its stickiness.

However, depending on kind of paper, disturbance of image is generated (remarkable on tracing paper). This image disturbance is conspicuous when a half-tone image is printed and is generated especially on the leading edge and trailing edge of a paper in a low humidity environment (especially conspicuous at the trailing edge).

One cause of this image disturbance is considered to be unnecessary discharge generated when the trailing edge of a paper leaped when it is separated from a transfer belt. As a result of this discharge, discharge traces in a pattern like foot marks of a crow are formed on the leading and trailing edge portions of a paper as shown in FIG. 2. These discharge traces appear remarkably especially on a half-tone image portion.

It is known that this phenomenon becomes inconspicuous gradually when increasing transfer voltage (current value).

However, if the transfer voltage is increased unnecessarily, drop of transfer efficiency, uneven transfer and other defects are caused. It is therefore difficult to simply increase transfer voltage uniformly.

SUMMARY OF THE INVENTION

The present invention has been made in view of the above-mentioned circumstances and it is an object of the present invention to provide an image forming apparatus capable of obtaining a satisfactory image without discharge traces on the leading and trailing edge portions of a paper by increasing transfer bias at the leading and trailing edge portions of a paper, wherein discharge traces tend to be generated, higher than the middle portion of a paper.

According to the present invention, an image forming apparatus is provided, which comprising image forming means for forming a developer image on an image carrier, transfer means for transferring the developer image on an image receiving medium, conveying means provided in contact with the transfer means for conveying the image receiving medium, voltage applying means for applying voltage to the transfer means, and control means for controlling the voltage to be applied to at least one of a leading edge and a trailing edge in the conveying direction of the image receiving medium so as to make the voltage larger than voltage that is applied to the middle portion in the conveying direction of the image receiving medium.

DETAILED DESCRIPTION OF THE PREFERRED EMBODIMENTS

Hereinafter, a first embodiment of the present invention will be described with reference to the attached drawings.

Figure 1:
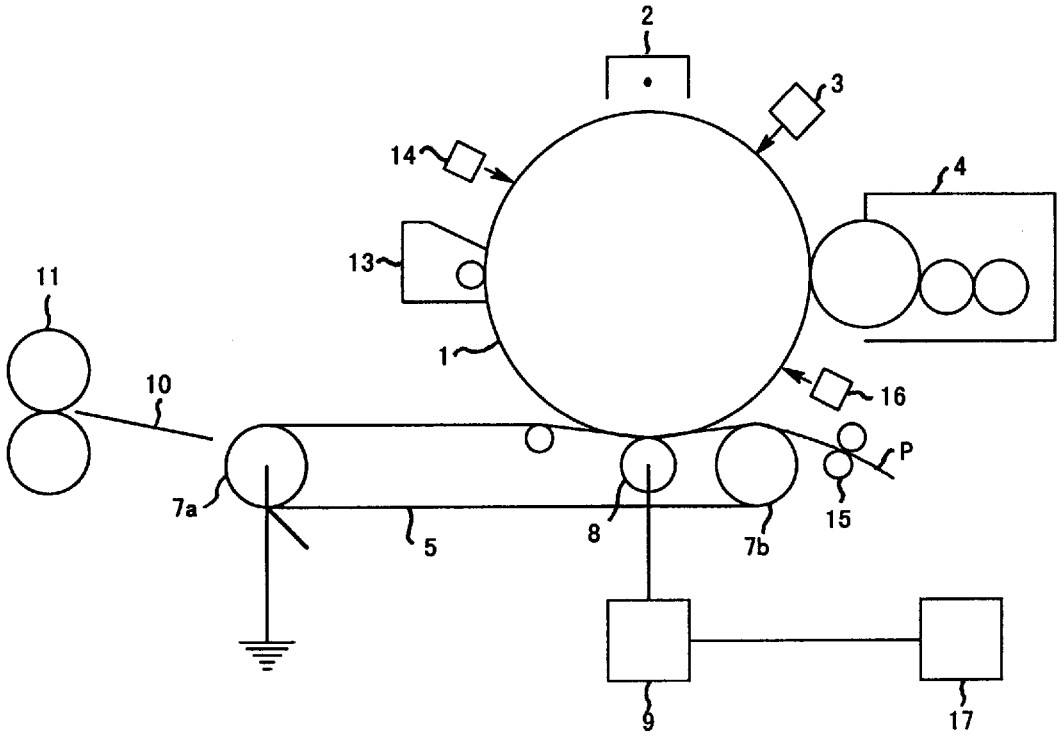
FIG. 1 is a schematic diagram showing a first embodiment of an image forming apparatus of the present invention.

FIG. 1 shows a copying machine as an image forming apparatus.

A photo-conductive drum 1 is uniformly applied with −500 V to −800 V surface potential by a main charger 2. Further, this first embodiment is described taking a negatively charged photo-conductive drum as an example and the same is applied to a positively charged photo-conductive drum as the difference is only the polarity that is reversed. An electrostatic latent image is formed on the photo-conductive drum 1 applied with the surface potential by an exposure unit 3 which is an image forming means. This electrostatic latent image becomes a toner image and is visualized when a toner that was negatively charged by a developing device 4 is supplied.

A transfer belt 5 which is a conveying member is pushed against the photo-conductive drum 1 and a paper P as an image receiving medium is put between the transfer belt 5 and the photo-conductive drum 1. Further, bias (+300 to 5 kV) is applied to the transfer belt 5 by a high voltage supply 9 which is a voltage applying means and a toner image formed on the photo-conductive drum 1 is transferred on the paper P. Voltage applied by the high voltage supply 9 is controlled by a controller 17.

The transfer belt 5 is an elastic belt having the volume resistance $10^8$–$10^{12}$ Ω·cm, put over a driving roller 7*a* and a driven roller 7*b* and runs at almost the same surface moving speed as the photo-conductive drum 1. At the back side of the area where the transfer belt 5 is kept in contact with the photo-conductive drum 1, an electric power supply roller 8 which is an electric power supply member (a transfer means) is kept in contact with the transfer belt 5 so as to be able to supply electric power through the back of the transfer belt 5. The electric power supply roller 8 is composed of an elastic roller having the volume resistance $10^2$–$10^8$ Ω·cm.

In the ordinary printing, the transfer belt 5 and the photo-conductive drum 1 are driven in the state where they are kept separated from each other and after their surface moving speeds become nearly the same, they are brought in contact with each other. Then, at the same time when the transfer bias voltage is applied to the electric power supply roller 8, the paper P is conveyed to the transfer nipping area. After passing through the transfer nipping area, the paper P is adsorbed electrostatically on the transfer belt 5 and the leading edge of the paper P is separated from the transfer belt 5 at the most downstream side in the traveling direction of the transfer belt 5 because the radius of curvature of the transfer belt 5 on the driving roller 7*a* is small (normally, approximately 12–40 mm). The paper P separated from the transfer belt 5 is conveyed to a fixer 11 after passing through a guide member 10.

After transferring a toner image, the toner left on the photo-conductive drum 1 is removed by a cleaner 13. After removing this residual toner, the surface of the photo-conductive drum 1 is discharged by a charge eliminator 14 for the next processing.

Figure 2:
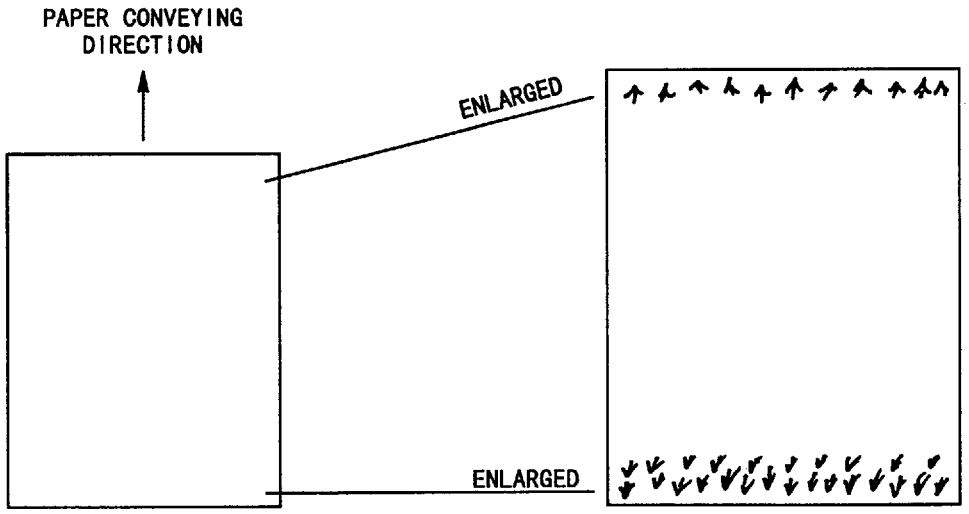
FIG. 2 is a plan view showing discharge traces at the leading edge portion and the trailing edge portion of a paper.

Now, when a half-tone image is printed in a low humidity environment on the copying machine that is in said structure, discharge traces (image disturbance) are produced at the leading and trailing edges of the paper P as shown in FIG. 2.

As a testing machine, a copying machine using a reversal developing with a process speed 400 mm/sec, equipped with a negatively charged photo-conductive drum 1 (approximately 100 mm) was used at charging potential −600 V and developing bias −400 V.

The transfer belt 5 used is a semi-conductive rubber made belt having the volume resistance $10^9$ Ω·cm coated with a surface layer. The surface layer has a resistance that is greater than the resistance of rubber. The surface layer has a thickness of 3–10 μm. Further, the electric power supply roller 8 used was a roller having the volume resistance about $10^5$ Ω·cm and hardness 40° (Asker-C).

According to the test results, the discharge traces were recognized remarkably on the half-tone image portion of a tracing paper at the transfer current around 50 μA but became considerably inconspicuous at 100 μA.

Figure 3:
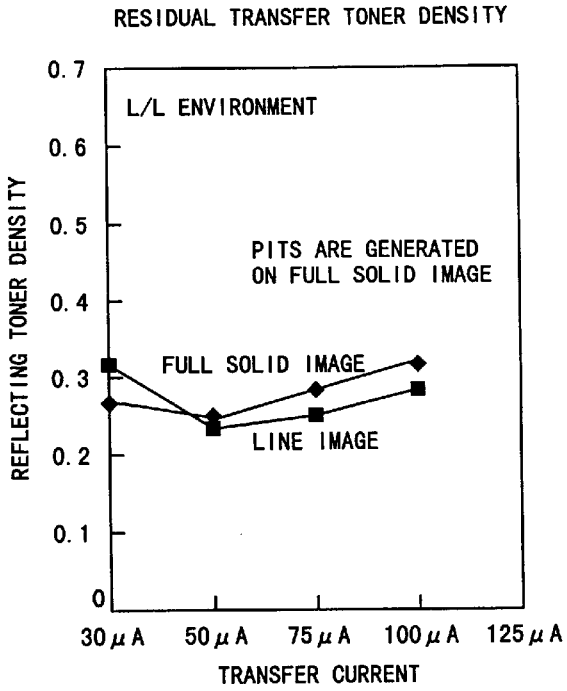
FIG. 3 is a graph showing the density of residual toner left on a photo-conductive drum when transfer current was changed in a low temperature and low humidity environment.
Figure 4:
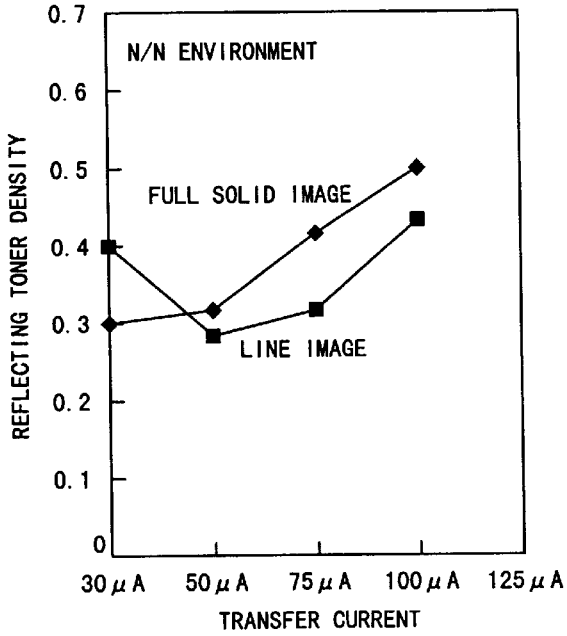
FIG. 4 is a graph showing the density of residual toner left on a photo-conductive drum when transfer current was changed in a normal temperature and normal humidity environment.
Figure 5:
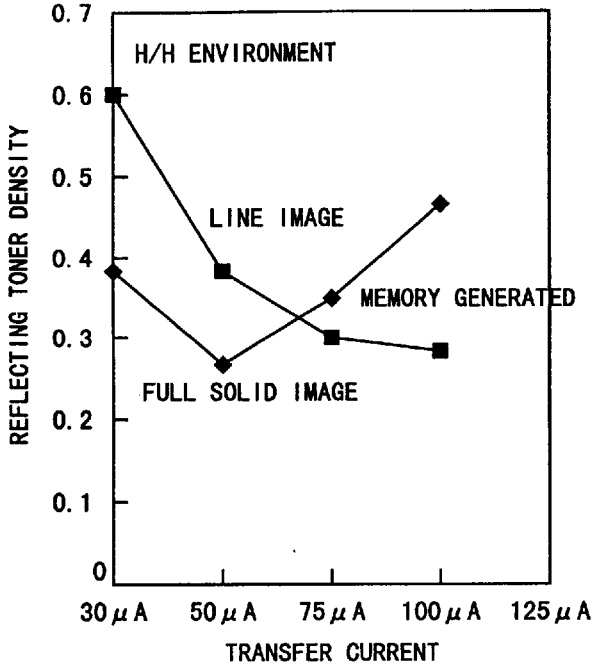
FIG. 5 is a graph showing the density of residual toner left on a photo-conductive drum when transfer current was changed in a high temperature and high humidity environment.

In the L/L (10° C., 20%), N/N (21° C., 50%) and H/H (30° C., 85%) environments, residual toners left on the photo-conductive drum 1 were taken by a tape. FIG. 3 through FIG. 5 show the reflection densities of the toners thus taken on tapes which were then put on a white paper. The more low this density is, the better the transfer efficiency.

According to the test results, the amount of residual toner left on the photo-conductive drum was less and satisfactory at the transfer current around 50 μA except the line image in the H/H environment. However, if the transfer current higher than 100 μA was applied, the amount of residual toner increases on a whole. In particular, in case of a full solid image, a transferred image is spotted and its image quality is deteriorated.

Figure 6:
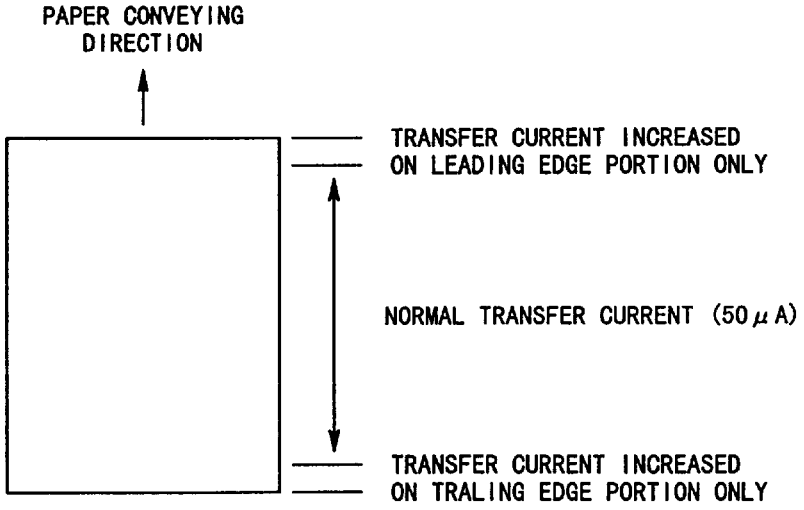
FIG. 6 is a plan view showing the state of transfer current applied to a paper.

So, in this first embodiment, the bias voltage applied to the electric power supply roller 8 was increased so as to make the transfer current applied by the controller 17 to the leading and trailing edges only of the paper P where the discharge traces tend to be produced larger than other image areas as shown in FIG. 6.

As a result, it becomes possible to make the discharge traces inconspicuous without giving a large effect to the normal naked eye although the amount of residual transfer toner on the photo-conductive drum except the line image in the H/H environment. However, the satisfactory image transfer performance can be obtained at the central portion of the paper P.

In the test, the central portion of the paper P was constantly controlled at the transfer current 50 μA and the 15 mm wide areas only of the leading and trailing edges of a paper P were controlled at 75–100 μA.

Figure 7:
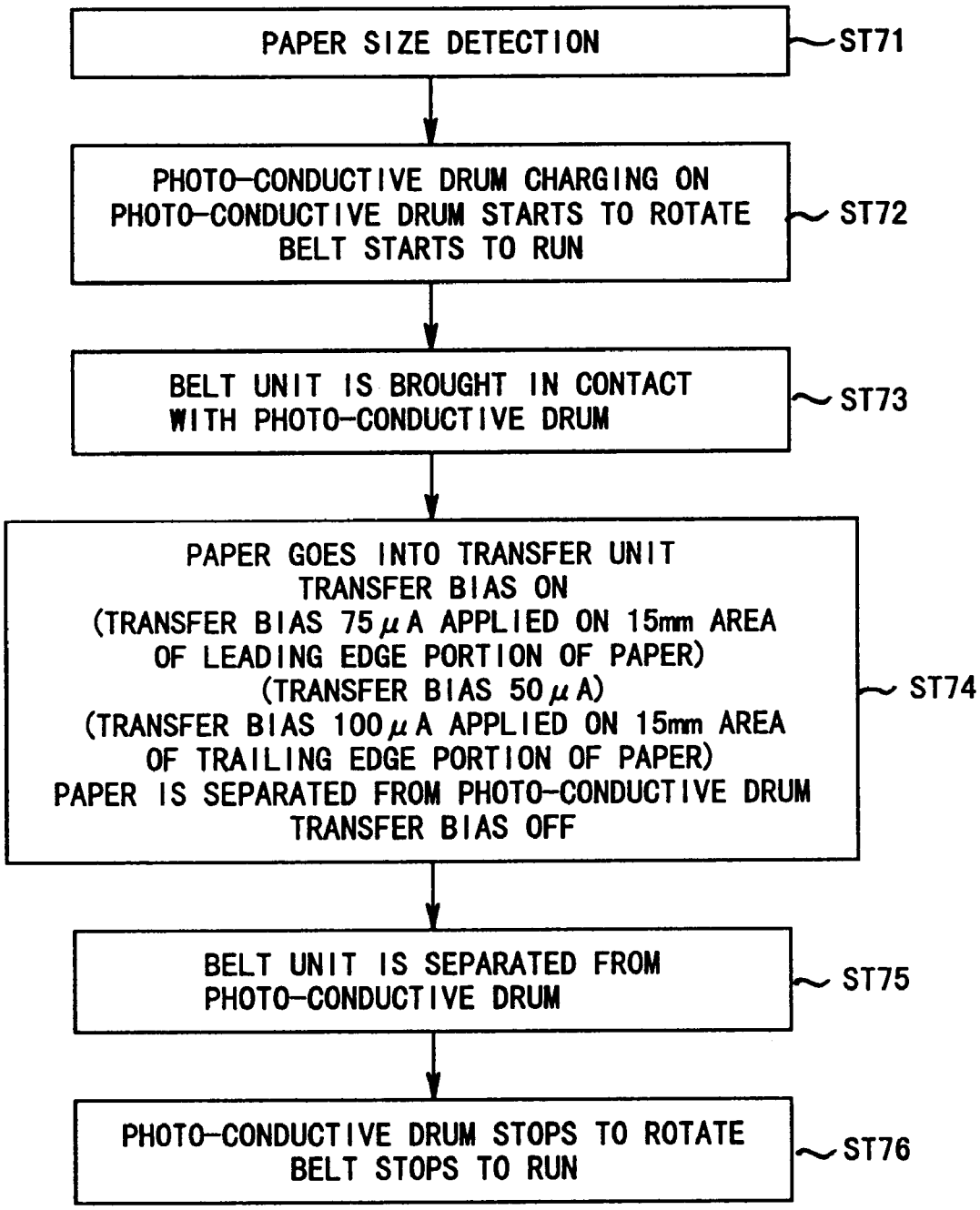
FIG. 7 is a flowchart showing the image forming operation.

FIG. 7 is a diagram showing the flowchart of the image forming operation.

TABLE 1

| | | | Image Printing Results | | | | | |
|---|---|---|---|---|---|---|---|---|
| Environment | Kind of Paper | Kind of Chart | 30 μA | 50 μA | 75 μA | 100 μA | 125 μA | 150 μA |
| L/L Environment | 64 g Paper | Character Chart | Defective transfer | ○ | ○ | ○ | | |
| | | Half-tone Chart | Many discharge traces | Few discharge traces | Few discharge traces | ○ | ○ | ○ |
| | Tracing Paper | Character Chart | Defective transfer | ○ | ○ | ○ | | |
| | | Half-tone Chart | Many discharge traces | Few discharge traces | Few discharge traces | ○ | ○ | ○ |
| N/N Environment | 64 g Paper | Character Chart | Defective transfer | ○ | ○ | ○ | | |
| | | Half-tone Chart | ○ | ○ | ○ | ○ | | |
| | Tracing Paper | Character Chart | Defective transfer | ○ | ○ | ○ | | |
| | | Half-tone Chart | Many discharge traces | Few discharge traces | Few discharge traces | ○ | | |
| H/H Environment | 64 g Paper | Character Chart | | ○ | ○ | ○ | ○ | |
| | | Half-tone Chart | ○ | ○ | ○ | ○ | ○ | |
| | Tracing Paper | Character Chart | | ○ | | | | |
| | | Half-tone Chart | ○ | ○ | ○ | ○ | ○ | ○ |

○: No discharge trace appears and a formed image is satisfactory.

The discharge traces appear remarkably on a thin paper containing much resin component and become not noticeable with the increase of transfer current.

Table 1 shows the results of images printed on a 64 g paper (ordinary paper) and a tracing paper under the so-called constant current control; that is, bias current applied to the electric power supply roller 8 is changed by the controller 17 in the environments of low temperature/low humidity (10° C., 20%), normal temperature/normal humidity (21° C., 50%) and high temperature/high humidity (30° C., 85%).

When forming an image, size of the paper P is first detected (STEP ST71). Then, at the same time when the main charger 2 is turned ON, the photo-conductive drum 1 is rotated and further, the transfer belt 5 is run (STEP ST72). Then, when the rotating speed of the photo-conductive drum 1 becomes equal to the running speed of the transfer belt 5, the transfer belt 5 is brought in contact with the photo-conductive drum 1 (STEP ST73). Thereafter, the paper P is conveyed between the transfer belt 5 and the photo-conductive drum 1 and is applied with the transfer bias voltage. The transfer bias voltage is applied so that the transfer current 75 μA flows through the 15 mm wide area of the leading edge portion, 50 μA through the central portion and 100 μA through the 15 mm wide area of the trailing edge portion of the paper P. When the transfer belt 5 runs and the paper P is separated from the photo-conductive drum 1, the application of the transfer bias voltage is turned OFF (STEP ST74). After turning off the transfer bias voltage, the transfer belt 5 is separated from the photo-conductive drum 1 (STEP ST75) and then, the photo-conductive drum 1 is stopped to rotate and the transfer belt 5 is stopped to run (STEP ST76).

Therefore, when the transfer current is controlled minutely to 75 μA at the leading edge portion of the paper P, 50 μA at the prime image portion (that is, the middle portion and 100 μA at the trailing edge portion,) it becomes possible to make the discharge traces at the leading and trailing edge portions of the paper P inconspicuous while reducing a residual toner left on the photo-conductive drum.

As the discharge traces are conspicuous in the area of about 10 mm from the edge at both the leading and trailing edge portions of the paper P, when the transfer current is intensified, it is effective even in the width of about 10 mm. However, as the whole discharge traces are not always confined in the width of 10 mm, it is desirable to make the width to about 15 mm.

Further, if the electric field of transfer current is intensified suddenly, the transfer efficiency may change when switched and streaks may be produced on an image. So, it is preferable to control the current so as to increase it at the position of 15 mm from the trailing edge of the paper P and terminate to increase it when the position of about 10 mm is reached.

TABLE 2

Discharge traces generating state when transfer currrent values at the leading and trailing edges of paper are changed
*Transfer currert was fixed at 50 μA for the middle portion other than the 15 mm wide porbon of the leading and trailing edges of paper

| | | From Trailing Edge To 15 mm Point | | |
|---|---|---|---|---|
| | | 50 μA | 75 μA | 100 μA |
| From Leading Edge To 15 mm Point | 50 μA | Generated at both the leading and trailing edge portions | Generated at both the leading and trailing edge portions | Generated at the leading edge portion |
| | 74 μA | Generated at the trailing edge portion | Generated at the trailing edge portion | Not generated (inconspicuous) |
| | 100 μA | Generated at the trailing edge portion | Generated at the trailing edge portion | Nor generated (inconspicuous) |

Table 2 shows the discharge traces generating state.

The discharge traces at the leading edge portion of the paper P become inconspicuous at the transfer current 75 μA and those at the trailing edge portion becomes almost not recognizable at 100 μA.

Next, a second embodiment of the present invention will be described.

When the constant current control is made, a proper transfer current value changes according to a transfer image area.

TABLE 3

Transfer voltage according to difference in printing state
(Voltage applied to the electric power supply roller at the constant current control)

| | | | Transfer Bias Voltage (kV) | | | | |
|---|---|---|---|---|---|---|---|
| | | | 30 μA | 50 μA | 75 μA | 100 μA | 125 μA |
| L/L Environment | 64 g Paper | White Print | 1.75 | 2.5 | 3 | 3.5 | 3.85 |
| | | Black Print | | 2.7 | 3.1 | 3.6 | |
| | No Paper | White Print | 1.2 | 1.5 | 1.95 | 2.4 | 2.7 |
| H/H Environment | 64 g Paper | White Print | | 1.05 | 1.45 | 1.85 | 2.05 |
| | | Black Print | | 1.65 | 1.95 | 2.35 | 2.5 |
| | No Paper | White Print | | 0.75 | 1.15 | 1.5 | 1.85 |

Table 3 shows the results of voltage values compared in the white and black prints using a test equipment.

According to Table 3, the transfer voltage in the black printing tends to become higher by about 500 V than the white printing (H/H Environment) and further, even when seeing the graphs of residual toner density left on the photo-conductive drum shown in FIG. 3 to FIG. 5, a proper current value in the black printing becomes lower than that in the white printing.

In this second embodiment, a charge elimination lamp 16 is provided as a charge elimination means at the location below the developing device 4. Only the parts of the photo-conductive drum 1 corresponding to the leading and trailing edge portions of the paper P or the trailing edge portion wherein the discharge traces are especially conspicuous are discharged by the charge elimination lamp 16 before transferring an image. Thus, a proper current value is made lower than a conventional half-tone image as a result so that the transfer voltage becomes high at the positions corresponding to the leading and trailing edge portions of a paper even when the applied current itself is not made high.

TABLE 4

Discharge traces generating state when transfer current values for the leading and trailing edge portions were made high and the pre-transfer charge elimination was performed
*Transfer current was fixed at 50 μA for the portion other than the 15 mm wide portion of the leading and trailing edges of a paper

| | | No Pre-Transfer Charge Elimination | Pre-Transfer Charge Elimination for Trailing Edge Only | Pre-Transfer Charge Elimination for Leading & Trailing Edges |
|---|---|---|---|---|
| From Leading & Trailing Edges TO 15 mm Point | 50 μA | Generated at both leading & trailing edge portions | Number of discharge traces at leading edge portion was reduced | Number of discharge traces at bothe leading & trailing edge portions was reduced |
| | 75 μA | Generated in trailing edge portions | Not gererated (inconspicuous) | Not generated (inconspicuous) |
| | 100 μA | Generated in trailing edge portions | Not generated (inconspicuous) | Not generated (inconspicuous) |

Table 4 shows the discharge traces generating state.

The light of the charge elimination lamp was applied to the range of 15 mm of the parts of the photo-conductive drum 1 corresponding to the leading and trailing edges of the paper P using the pre-transfer charge eliminating lamp 16 that is the same as the charge eliminator 14 for the photo-conductive drum 1.

According to Table 4, the number of discharge traces was decreased without changing the transfer current value because the parts of the photo-conductive drum 1 corresponding to the leading and trailing edge portions were discharged before the transfer of image.

Further, there is a tendency that no discharge traces are produced in the leading and trailing edge portions of a paper when the pre-transfer charge elimination was made even if current increasing amount is less than that when the pre-transfer charge elimination was not performed. In this second embodiment, there is not a small effect although less than the first embodiment.

Further, when the pre-transfer charge elimination was made, the white ground potential of the photo-conductive drum 1 drops and therefore, a toner for the black character portion scatters to the white ground portion, generating a scattering of toner around characters. This scattering of toner around characters denotes the state of toner scattered and adhered around original characters and the contrast of characters to the ground became weak. However, this state will scarcely become a problem if it is generated only in the leading and trailing edge portions of a paper.

Next, a third embodiment of the present invention will be described.

As mentioned above, a proper current value changes according to an image area to be transferred in the constant current control. This is because the surface potential of the photo-conductive drum 1 differs on the white ground and the black ground and this can be solved when the surface potentials of the white and black grounds are brought close to each other.

The pre-transfer charge elimination is considered to be an effective means but, as a negative side effect, a scattering of toner around characters is generated during the image transfer.

In this third embodiment, the pre-transfer charge elimination is normally performed at an incomplete level of potential where the scattering of toner around characters is scarcely generated. Thus, the weak point of the constant current control is offset. In addition, the effect of the second embodiment is also obtained by discharging the leading and trailing edge portions or the trailing edge portion only of the paper P more strongly than the middle portion.

TABLE 5

Scattering of toner around characters when white ground potential was changed

| White Ground Potential (V) | L/L Environment | H/H Environment |
|---|---|---|
| −500 | Normal condition | Normal condition |
| −400 | No change | No change |
| −300 | No change | No change |
| −200 | Slight scattering generated | Becomes thick |
| −100 | Scattering generated | Scattering generated |
| −20 | Scattering generated | Largely becom thick |

Transfer current was fixed at 50 μA

Table 5 shows the state of the scattering of toner around characters when the surface potential of the photo-conductive drum immediately before the image transfer was changed by changing the light quantity of the pre-transfer charge elimination. Further, "Becomes thick" shown in Table 5 means that the scattering of toner around characters becomes conspicuous and lines composing characters become thick.

According to Table 5, it is seen that the scattering of toner around characters becomes conspicuous when the white ground potential becomes below −200 V and it is scarcely generated when the white ground potential is above −300 V.

So, the quantity of light of the pre-transfer charge elimination lamp was adjusted so that the surface potential of the majority of the white ground becomes always −300 V and the white ground potential is completely discharged (about −20 V) at the 15 mm wide portions of the leading and trailing edges of the paper P.

In this case, as the leading and trailing edge portions of the paper P become the entirely same state as in the second embodiment, it is possible to make discharge traces inconspicuous and at the same time, offset the weak point of the constant current control by utilizing the specially mounted pre-transfer charge eliminating mechanism.

Figure 8:
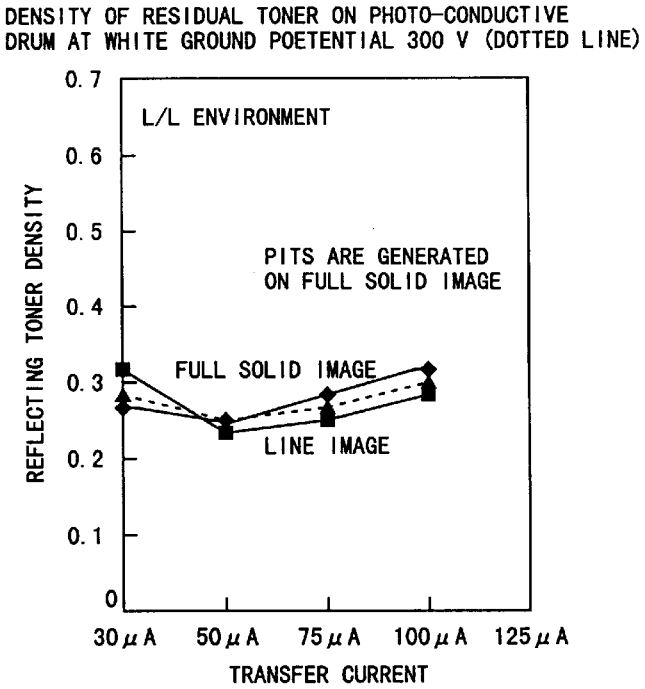
FIG. 8 is a graph showing the density of residual toner left on a photo-conductive drum when transfer current was changed in a low temperature and low humidity environment.
Figure 9:
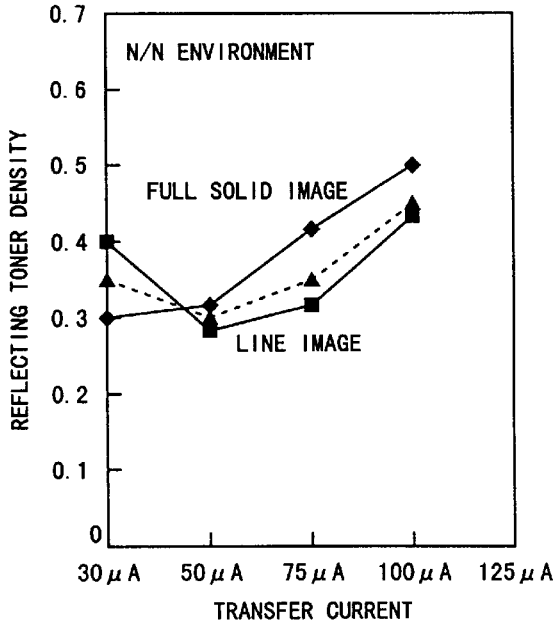
FIG. 9 is a graph showing the density of residual toner left on a photo-conductive drum when transfer current was changed in a normal temperature and normal humidity environment.
Figure 10:
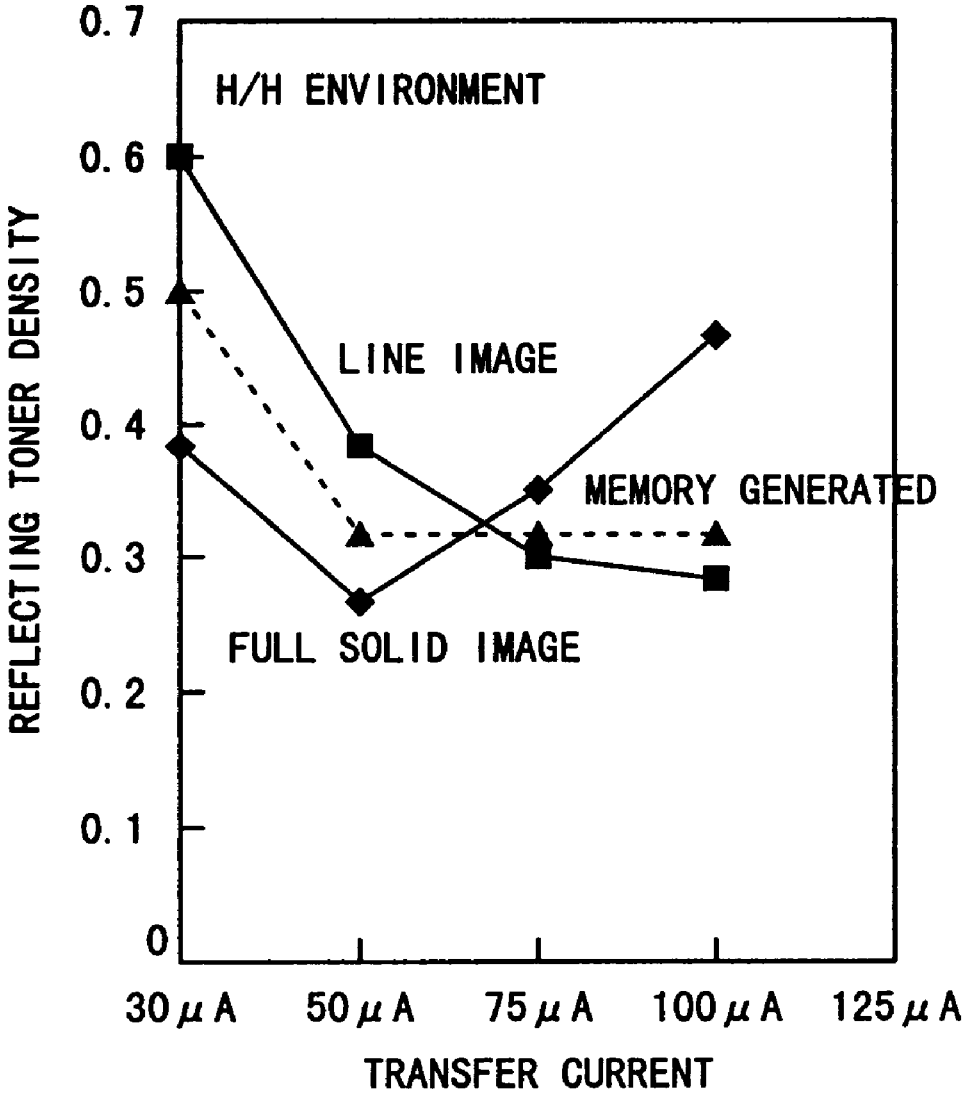
FIG. 10 is a graph showing the density of residual toner let on a photo-conductive drum when transfer current was changed in a high temperature and high humidity environment.

The result of comparison of density of residual toner left on the photo-conductive drum is shown in FIG. 8 through FIG. 10.

Shown by the dotted line in these figures is the density of residual toner on the photo-conductive drum when the white ground potential was made to −300 V using the pre-transfer charge elimination applied to a line figure and it can be seen that it is close to the characteristic of a full solid image when compared with a line image in the normal state shown by the solid line in all environments.

In such the construction, it becomes possible to offset a difference in amount of residual toner between the white ground and the black ground even in the area where no toner scattering around characteristics is produced and also, to make discharge traces inconspicuous at the leading and trailing edges of a paper as in the second embodiment.

In said first through the third embodiments, it is a principal object to make discharge traces generated mainly on a tracing paper inconspicuous in the low humidity environment. In the first and second embodiments, the transfer possibility is rather lowered partially if discharge traces are not produced.

So, if these operations can be limited as could as possible when tracing paper and the like are used instead of ordinary paper, it is very convenient.

For instance, on normal digital copying machines, tracing paper is not used by setting in a paper supply cassette but used almost 100% in the manual feeding mode.

Therefore, if the first through third embodiments are applied only in the manual feeding mode, ordinary paper is processed in the normal transfer processing in many cases and increase in residual toner or generation of uneven image transfer will become less even on the leading and trailing edges of a paper.

Further, although an image forming apparatus may become large in size, the first through third embodiments may be selected for application by detecting kind of paper to be used.

For instance, an apparatus may be so designed that kind of paper can be input by user by pushing a button, etc. and it is one of methods to perform such the control for only light permeable thin paper by detecting the transmission factor, etc. of paper.

In addition, as the generation of discharge traces is a matter occurred only in the low humidity environment, it may be better to provide a humidity sensor to a photographic apparatus so that one of the first through third embodiments is applied automatically when the humidity becomes below 30–50%.

Further, in case of a digital copying machine, the state of output image is variable largely according to the image processing.

In case of a half-tone image of resolution about 400 dpi, discharge traces become scarcely conspicuous depending on the method of processing.

Since discharge traces become conspicuous only in case of highly precise images and analog half-tone images, if the first through third embodiments are applied only when user desires to output a highly precise image close to a photograph, satisfactory printing can be made without generating such defects as increase in waste toner and the like in the normal character printing, etc.

In other words, various examples as follows are thought about.

That is, it is discriminated as to whether it is the photographic mode or not. In case of the photographic mode, it is discriminated as to whether it is the manual feeding mode. In case of the manual feeding mode, the present invention is applicable. If it is not the photographic mode nor the manual feeding mode, the process may be put in the normal process.

According to this embodiment, it is possible to print an image of high quality on a tracing paper relatively easily without using a large-scaled sensor, etc.

Further, it is discriminated as to whether a value of a humidity sensor is less than an established standard. If yes, it is then discriminated as to whether a transmission factor of paper is less than an established reference. When yes, the present invention is applicable. If a value of the humidity sensor and a transmission factor of paper are not less than an established standard, it is put in the normal process.

According to this embodiment, sensors for detecting a transmission factor and humidity of paper are required but unless an OHP having a high transmission factor, etc. are used in the low humidity environment, the present invention will never be applied unnecessarily.

As described above, according to the present invention, it is possible to obtain such effects to reduce disturbance of image by discharge traces on the leading and trailing edges of a paper that is generated in the low humidity environment and obtain a satisfactory image quality without specially requiring a charge eliminator of a paper such as a corona charger, etc.

What is claimed:

1. An image forming apparatus comprising:

image forming means for forming a developer image on an image carrier;

transfer means for transferring the developer image onto an image receiving medium;

conveying means provided in contact with the transfer means for conveying the image receiving medium in a conveying direction;

voltage applying means for applying voltage to the transfer means; and control means for controlling the voltage to be applied to a trailing edge in the conveying direction of the image receiving medium so as to make the voltage larger than a voltage that is applied to a middle portion in the conveying direction of the image receiving medium.

2. An image forming apparatus as set forth in claim 1, wherein the conveying means includes:

a pair of rollers provided separate from each other; and an endless belt that is put over the pair of rollers and kept in contact with the surface of the image carrier.

3. An image forming apparatus as set forth in claim 2, wherein the transfer means includes an electric power supply roller kept in contact with the image carrier via the endless belt.

4. An image forming apparatus comprising:

image forming means for forming a developer image on an image carrier, the image forming means having modes to form images on the image carrier, including a normal mode and a photographic mode for document images which are photographs, an automatic mode to automatically feed an image receiving medium and a manual mode to feed the image receiving medium by manually inserting;

transfer means for transferring the developer image onto the image receiving medium;

conveying means provided in contact with the transfer means for conveying the image receiving medium in a conveying direction;

voltage applying means for applying voltage to the transfer means; and control means for controlling the voltage to be applied by the voltage applying means to a trailing edge portion of the image receiving medium in the conveying direction so that the voltage becomes larger than a voltage to be applied to a middle portion in the conveying direction of the image receiving medium when the image receiving medium is supplied to the transfer means in the manual mode or when the image forming means is in the photographic mode.

5. An image forming apparatus comprising:

image forming means for forming a developer image on an image carrier;

transfer means for transferring the developer image onto an image receiving medium;

conveying means provided in contact with the transfer means for conveying the image receiving medium in a conveying direction;

voltage applying means for applying voltage to the transfer means;

control means for controlling the voltage to be applied to a trailing edge in the conveying direction of the image receiving medium so as to make the voltage larger than a voltage that is applied to a middle portion in the conveying direction of the image receiving medium;

first detecting means for detecting ambient humidity; and second detecting means for detecting a kind of the image receiving medium; and wherein the control means controls the voltage to be applied by the voltage applying means to at least one of a leading edge and the trailing edge of the image receiving medium in the conveying direction so that the voltage becomes larger than a voltage to be applied to the middle portion in the conveying direction of the image receiving medium wherein the results of the detection by the first or second detecting means affect the operation of the control means.

6. An image forming apparatus comprising:

image forming means for forming a developer image on an image carrier, the image forming means having modes to form images on the image carrier, including a normal mode and a photographic mode for document images which are photographs, an automatic mode to automatically supply an image receiving medium and a manual mode to supply the image receiving medium by manually inserting;

transfer means for transferring the developer image onto the image receiving medium;

conveying means provided in contact with the transfer means for conveying the image receiving medium in a conveying direction;

voltage applying means for applying voltage to the transfer means; and charge elimination means for eliminating the charge on the portions of the image carrier corresponding to a leading and a trailing edge in the conveying direction or the trailing edge only of the image receiving medium before the image receiving medium is brought into contact with the image carrier when the image receiving medium is supplied to the transfer means in the manual mode or the image forming means is in the photographic mode.

7. An image forming apparatus comprising:

image forming means for forming a developer image on an image carrier;

transfer means for transferring the developer image onto an image receiving medium;

conveying means provided in contact with the transfer means for conveying the image receiving medium in a conveying direction;

voltage applying means for applying voltage to the transfer means;

charge eliminating means for eliminating a charge on the part of the image carrier corresponding to a leading and a trailing edge or the trailing edge only of the image receiving medium before the image receiving medium is brought into contact with the image carrier;

first detecting means for detecting ambient humidity; and second detecting means for detecting a kind of the image receiving medium;

wherein the result of detection by the first or second detecting means affects the operation of the charge eliminating means.

8. An image forming apparatus comprising:

image forming means for forming a developer image on an image carrier, the image forming means having modes to form images on the image carrier, including a normal mode and a photographic mode for document images which are photographs, an automatic mode to automatically supply an image receiving medium and a manual mode to supply the image receiving medium by manually inserting;

transfer means for transferring the developer image onto an image receiving medium;

conveying means provided in contact with the transfer means to convey the image receiving medium in a conveying direction;

charge eliminating means with charge eliminating intensity for eliminating a charge on the surface of the image carrier before the image receiving medium is brought into contact with the image carrier; and control means for making the charge eliminating intensity of the charge eliminating means at the areas of the image carrier corresponding to a leading and a trailing edge portions or the trailing edge portion only of the image receiving medium higher than other areas when the image receiving medium is supplied to the transfer means in the manual mode or when the image forming means is in the photographic mode.

9. An image forming apparatus comprising:

image forming means for forming a developer image on an image carrier;

transfer means for transferring the developer image onto an image receiving medium;

conveying means provided in contact with the transfer means to convey the image receiving medium in a conveying direction;

charge eliminating means with charge eliminating intensity for eliminating a charge on the surface of the image carrier before the image receiving medium is brought into contact with the image carrier;

control means for making the charge eliminating intensity of the charge eliminating means at the areas of the image carrier corresponding to leading and trailing edge portions or the trailing edge portion only of the image receiving medium higher than other areas;

first detecting means for detecting ambient humidity; and second detecting means for detecting a kind of the image receiving medium;

wherein the result of detection by the first or second detecting means affects the operation of the control means.

10. An image forming apparatus comprising:

image forming means for forming a developer image on an image carrier;

transfer means for transferring the developer image onto an image receiving medium;

conveying means provided in contact with the transfer means for conveying the image receiving medium in a conveying direction;

voltage applying means for applying voltage to the transfer means; and control means for controlling the voltage to be applied to both a leading edge and a trailing edge in the conveying direction of the image receiving medium so as to make the voltage larger than a voltage that is applied to a middle portion in the conveying direction of the image receiving medium.

* * * * *